US007074092B1

(12) United States Patent
Green et al.

(10) Patent No.: US 7,074,092 B1
(45) Date of Patent: Jul. 11, 2006

(54) ELECTRICAL CONNECTOR WITH CROSSTALK COMPENSATION

(75) Inventors: Michael Patrick Green, Mechanicsburg, PA (US); Linda Ellen Bert, Camp Hill, PA (US); Sam Denovich, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/017,246

(22) Filed: Dec. 20, 2004

(51) Int. Cl.
*H01R 24/00* (2006.01)

(52) U.S. Cl. ..... 439/676; 439/941

(58) Field of Classification Search ..... 439/62, 439/65, 941, 344, 676
See application file for complete search history.

(56) References Cited

U.S. PATENT DOCUMENTS 3,790,916 A * 2/1974 Keitel ..... 439/435
6,139,371 A 10/2000 Troutman et al.
6,155,881 A 12/2000 Arnett et al.
6,176,742 B1 * 1/2001 Arnett et al. ..... 439/620
6,186,834 B1 * 2/2001 Arnett et al. ..... 439/676
6,244,907 B1 * 6/2001 Arnett ..... 439/676
6,350,158 B1 2/2002 Arnett et al.
6,371,793 B1 * 4/2002 Doorhy et al. ..... 439/404
6,409,547 B1 * 6/2002 Reede ..... 439/676
6,468,097 B1 10/2002 Bernstein
6,547,604 B1 * 4/2003 Arnett et al. ..... 439/676
6,736,681 B1 * 5/2004 Arnett ..... 439/676
6,764,343 B1 * 7/2004 Ferentz ..... 439/620
6,767,257 B1 * 7/2004 Arnett et al. ..... 439/676
6,769,937 B1 * 8/2004 Roberts ..... 439/676

* cited by examiner

*Primary Examiner*—James R. Harvey

(57) ABSTRACT

An electrical jack includes a housing having a mating end configured to receive a mating plug. A plurality of signal contacts are arranged in differential pairs, and each of the signal contacts carries a signal from or to a plug contact in the mating plug. A plurality of compensation contacts are provided. Each compensation contact engages a respective plug contact in the mating plug independent of the signal contact, and the compensation contacts provide crosstalk compensation.

22 Claims, 4 Drawing Sheets

ELECTRICAL CONNECTOR WITH CROSSTALK COMPENSATION

BACKGROUND OF THE INVENTION

The invention relates generally to electrical connectors, and more particularly, to a modular connector with compensation for crosstalk among multiple signal paths through the connector.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

For example, a typical industry standard type RJ-45 communication connector includes four pairs of conductors defining four different signal paths. In conventional RJ-45 plug and jack connectors, all four pairs of conductors extend closely parallel to one another over a length of the connector body. Thus, signal crosstalk may be induced between and among different pairs of connector conductors. The amplitude of the crosstalk, or the degree of signal degradation, generally increases as the frequency increases. It is desirable to suppress or compensate for crosstalk, and ideally, the crosstalk compensation should be introduced as close as possible to the source of the crosstalk.

In the case of RJ-45 connectors, the plug design is controlled by industry standards which require it to contain a substantial amount of crosstalk. Therefore, efforts to counteract crosstalk are typically applied to the mating jack. In one approach, terminal contacts in the jack are formed with free ends that are deflected to contact a compensation coupling contact when a plug is mated with the jack. See, for example, U.S. Pat. No. 6,350,158. In general, the effectiveness of these measures is influenced by the proximity of the corrective measure to the main source of the crosstalk, e.g., the mating plug.

BRIEF DESCRIPTION OF THE INVENTION

In one aspect, an electrical jack is provided. The electrical jack includes a housing having a mating end configured to receive a mating plug. A plurality of signal contacts are arranged in differential pairs, and each of the signal contacts carries a signal from or to a plug contact in the mating plug. A plurality of compensation contacts are provided. Each compensation contact engages a respective plug contact in the mating plug independent of the signal contact, and the compensation contacts provide crosstalk compensation.

Optionally, the jack further includes one or more compensation elements selected to provide a desired crosstalk compensation, and at least two of the compensation contacts are connected to the compensation elements. The jack also includes a first circuit board and a second circuit board. The first circuit board holds the signal contacts and, the compensation contacts are connected to the second circuit board. The second circuit board includes the compensation elements. Alternatively, the compensation contacts are held in the housing and compensation elements are connected to the compensation contacts. The compensation contacts are non-current carrying contacts.

In another aspect, an electrical jack includes a housing having a mating end configured to receive a mating plug. A plurality of signal contacts carry signals from or to a plug contact in the mating plug. A plurality of compensation contacts are provided. Selected ones of the compensation contacts are connected to respective compensation elements. The compensation elements are selected to provide a desired noise compensation. The noise compensation is applied to a noise source in the mating plug.

DETAILED DESCRIPTION OF THE INVENTION

Figure 1:
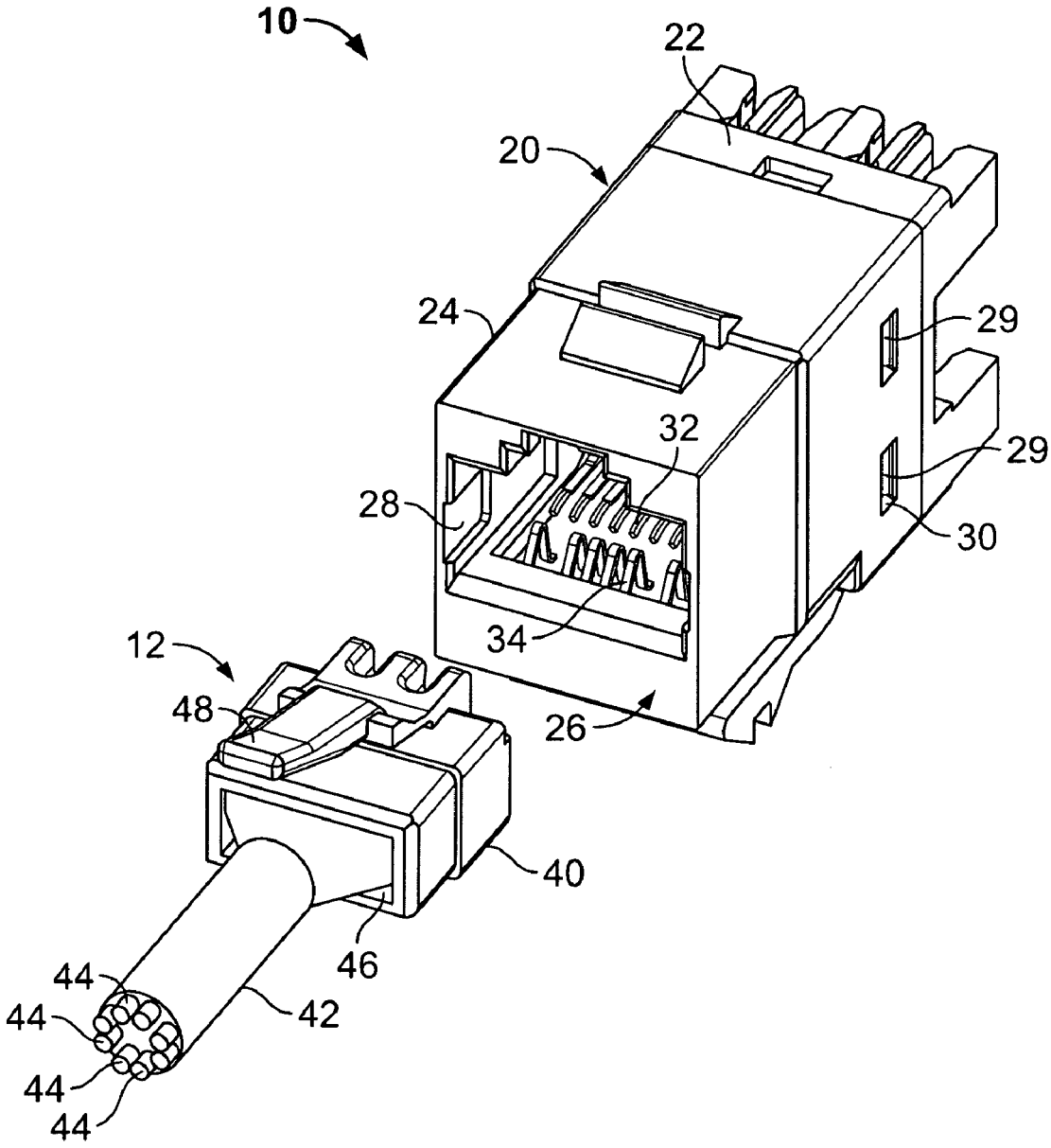
FIG. 1 is a perspective view of a connector having a jack formed in accordance with an exemplary embodiment of the present invention.

FIG. 1 is a perspective view of a connector having a jack 10 formed in accordance with an exemplary embodiment of the present invention, and a plug 12 that is configured to mate with the jack 10. The jack 10, in an exemplary embodiment, is a modular jack. The jack 10 may be mounted on a wall or panel, or, alternatively, may be mounted in an electrical device or apparatus having a communications port through which the device may communicate with other external networked devices. The jack 10 will be described in terms of an RJ-45 jack. However, it is to be understood that the benefits described herein are also applicable to other connectors in alternative embodiments. The following description is therefore provided for illustrative purposes only and is but one potential application of the inventive concepts herein.

The jack 10 includes a housing 20 that has a base portion 22 and a shell 24. The shell 24 includes a mating face 26 that defines an opening 28 that is configured to receive the mating plug 12. Latch members 29 on the base portion 22 are received in slots 30 in the shell 24 to retain the shell to the base portion 22 with snap fit engagement. The housing 20 includes a plurality of signal contacts 32 and a plurality of compensation contacts 34 in an interior of the shell 24. The compensation contacts 34 may or may not be equal in number to the number of signal contacts 32.

The plug 12 includes a plug housing 40 that receives a cable 42 that includes a number of signal wires 44 that are arranged in differential pairs. Each signal wire 44 is attached to a plug contact 50 (FIG. 2) within the plug housing 40. The cable 42 extends from a cable receiving end 46 of the housing 40. A lever 48 locks the plug 12 into the jack 10 with a snap fit. A plurality of plug contacts 50 (FIG. 2) engage the signal contacts 32 and the compensation contacts 34 when the plug 12 is mated to the jack 10.

Figure 2:
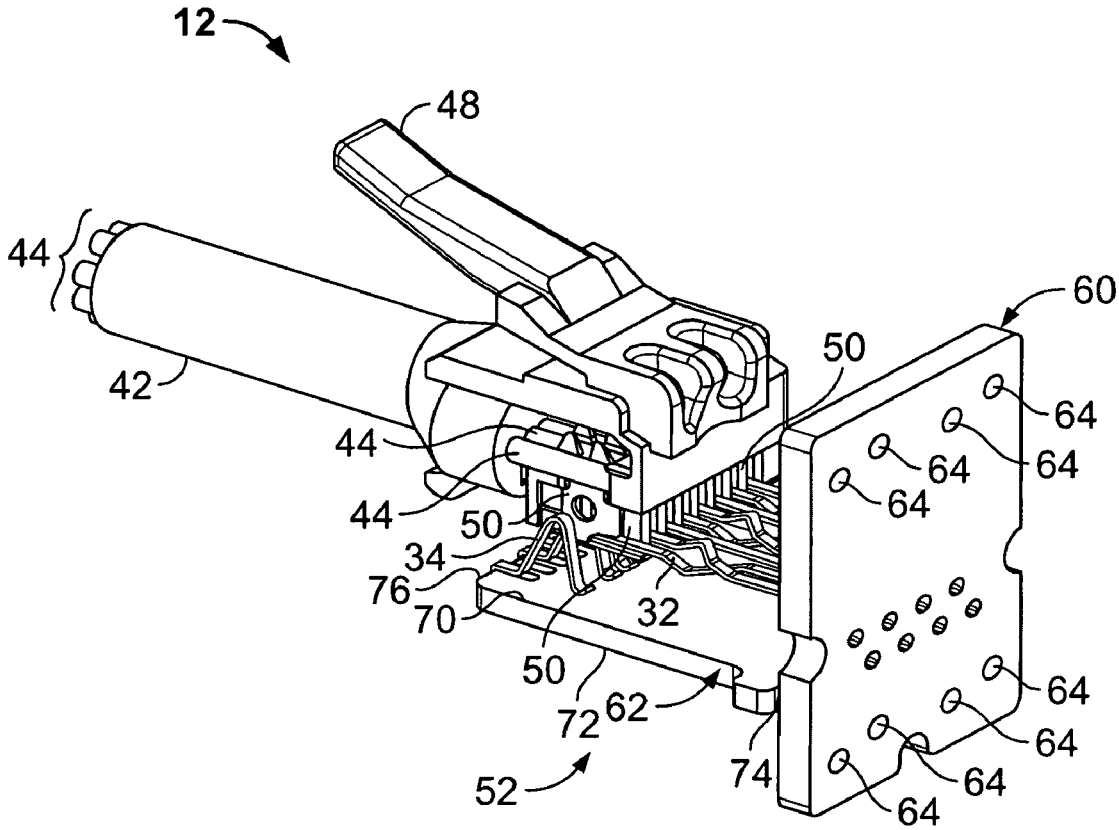
FIG. 2 is a perspective view of the plug shown in FIG. 1 mated with a jack insert formed in accordance with the present invention.

FIG. 2 is a perspective view of the plug 12 mated with a jack insert 52 formed in accordance with one embodiment of the present invention. The plug 12 houses plug contacts 50 that are attached to the signal wires in the cable 42. The plug contacts 50 are held in the plug housing 40. The plug contacts 50 are shown in mating engagement with the signal contacts 32 and the compensation contacts 34. A typical RJ-45 connector includes eight plug contacts 50. However, in some embodiments, some plug contacts 50 may not be present, or if present, may not be used.

In an exemplary embodiment, the jack insert 52 is contained within the jack housing 20. The jack insert 52 includes a first circuit board 60 and a second circuit board 62. The signal contacts 32 are mounted in the first circuit board 60. The signal contacts 32 are arranged in differential pairs. Traces in the first circuit board 60 electrically connect each signal contact 32 to a respective aperture 64 that is configured to receive an output terminal (not shown) that electrically connects the signal contact 32 to an output wire (not shown) that carries one of the differential signals from or to the plug 12 when the plug 12 is mated to the jack 10.

The second circuit board 62 includes an upper surface 70, a lower surface 72, an inward end 74 proximate the first circuit board 60, and an outward end 76 proximate the mating face 26 of the jack 10 (FIG. 1). The second circuit board 62 is housed in a channel (not shown) in the jack shell 24 (FIG. 1). In one embodiment, the compensation contacts 34 are mounted over the outward end of the second circuit board 62. In other embodiments, the compensation contacts 34 may take other forms. For instance, the compensation contacts 34 may be mounted in and upwardly extend from the upper surface 70 of the second circuit board 62. In one embodiment, one or more compensation elements (not shown) may be mounted on the second circuit board 62. Some or all of the compensation contacts 34 will electrically connect to one or more compensation elements (not shown) located on the second circuit board 62. The compensation elements are selected to provide a desired noise compensation to the mating plug contacts.

More specifically, the compensation elements are selected to provide a desired crosstalk compensation to counteract crosstalk at the plug contacts in the mating plug 12 through direct contact of the compensation contacts 34 with the plug contacts 50. From the perspective of the jack 10, the plug contacts 50 and the portion of the wires 44 contained within the plug housing 40 (FIG. 1) are considered to be a noise source, or more specifically, a source of crosstalk. Thus, in applying compensation directly to the plug contacts 50, the crosstalk compensation is applied to the source of the crosstalk.

In one embodiment, the compensation elements (not shown) include a conductive element that provides a reactance that is configured to counteract the crosstalk that is seen in the plug 12. In an exemplary embodiment, the reactance primarily includes a capacitance. The compensation elements may be formed using techniques well known in the art for such purposes. For example, two or more compensation contacts 34 may be placed in close proximity to each other so as to create the reactance to counteract the crosstalk. Another method may include placing conductors on the circuit board 62 in close proximity to one another, such as interlaced or aligned copper pairs. A third method may include placing discrete chips such as a capacitor on the circuit board 62. Still another method may include placing conductive plates in proximity with one another (see FIG. 5). The compensation elements may also include other circuit components that create a coupling to counteract the crosstalk within the plug 12.

Figure 3:
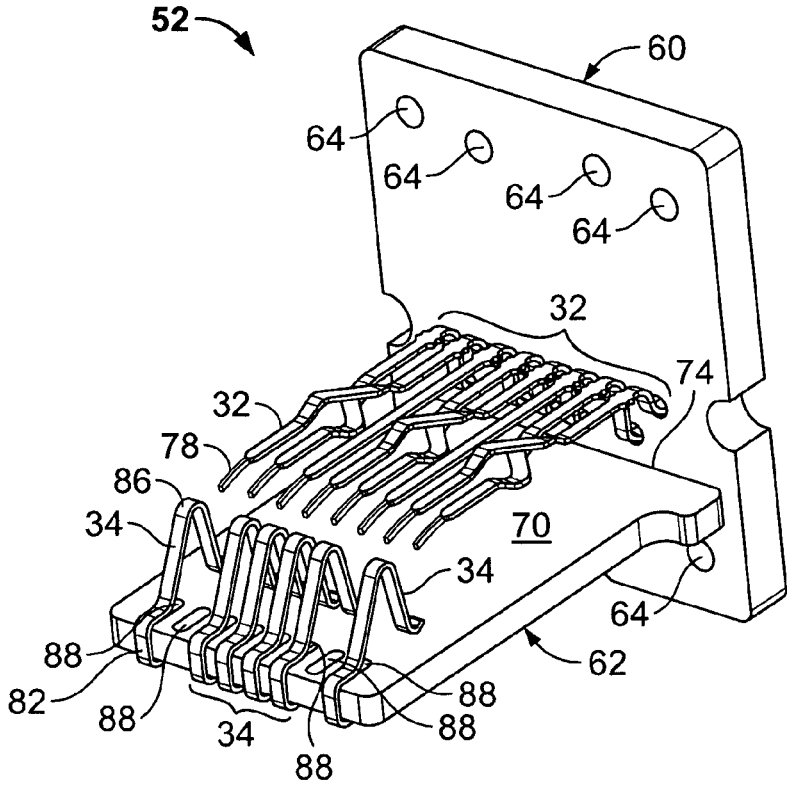
FIG. 3 is a perspective view of the jack insert shown in FIG. 2.
Figure 4:
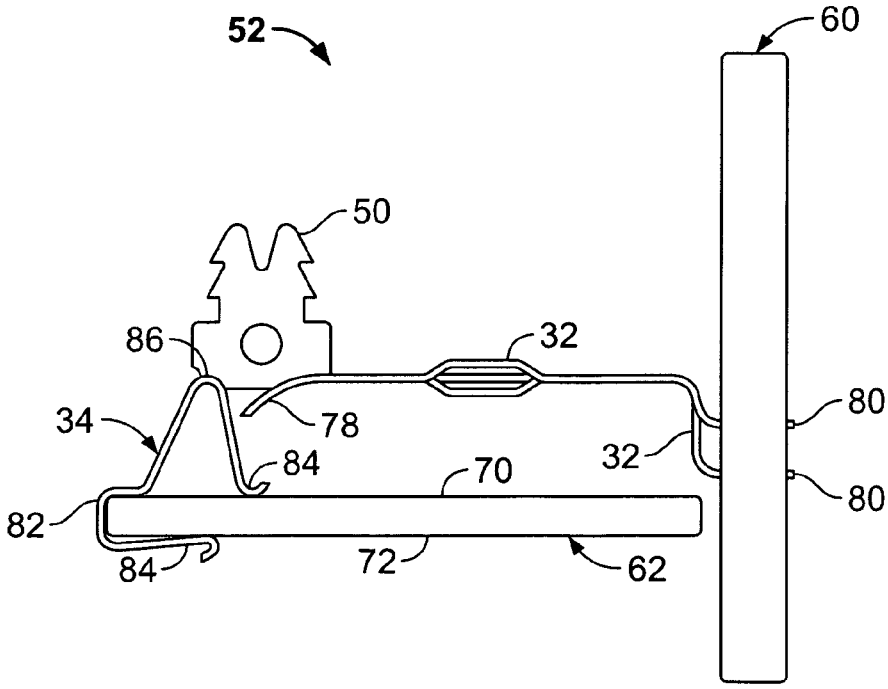
FIG. 4 is a side view of the jack insert shown in FIGS. 2 and 3 with mated plug contacts.

FIG. 3 illustrates a perspective view of the jack insert 52 in greater detail. FIG. 4 illustrates a side view of the jack insert 52 with mated plug contacts 50. The compensation contacts 34 are physically aligned with the signal contacts 32 within the jack 10, however, the number of compensation contacts 34 may or may not correspond to the number of signal contacts 32. When the plug 12 is mated with the jack 10, each of the plug contacts 50 is engaged by one of the signal contacts 32 and one of the compensation contacts 34 within the jack 10 when both the signal contact 32 and the compensation contact 34 are present. In one embodiment of the invention, the signal contacts 32 and the compensation contacts 34 are oriented within the jack 10 such that as the plug 12 is mated with the jack 10, the plug contacts 50 engage the compensation contacts 34 prior to engaging the signal contacts 32. In other embodiments, the compensation contacts 34 can be placed such that the plug contacts 50 engage the signal contacts 32 prior to engaging the compensation contacts 34. The compensation contacts 34, which are non-current carrying contacts, and the signal contacts 32 engage the plug contacts 50 independently of one another regardless of the order of engagement of the signal contacts 32 and the compensation contacts 34 with the plug contacts 50. The signal contacts 32 and the compensation contacts 34 are not electrically connected to one another other than through the plug contacts 50.

Each signal contact 32 includes an engagement end 78 that engages the plug contact 50 when the plug 12 (FIG. 2) is mated to the jack 10 (FIG. 1). Mounting ends 80 of the signal contacts 32 are received in the first circuit board 60 and are electrically connected to traces (not shown) in the first circuit board 60.

In an exemplary embodiment, each compensation contact 34 includes an attachment loop 82 that loops over the outward end 76 of the circuit board 62. Bend portions 84 cooperate with the loop 82 so that the compensation contact 34 grasps the outward end 76 of the second circuit board 62 to frictionally engage the upper and lower surfaces 70 and 72 of the second circuit board 62. A contact arch 86 mates with the plug contact 50 when the plug 12 is mated with the jack 10. The compensation contacts 34 may be electrically connected to the second circuit board 62 through contact pads 88. In one embodiment, the contact pads 88 are placed on the upper surface 70 of the second circuit board 62. In other embodiments, the contact pads may be placed on either or both of the upper and lower surfaces, 70 and 72 respectively, of the second circuit board 62. In alternative embodiments, the compensation contacts 34 may take other forms. For instance, the compensation contacts may include mounting ends that are mounted in the second circuit board 62 and curved contact ends as opposed to the contact arches 86.

The second circuit board 62 includes compensation elements (not shown) that are electrically connected to some or all of the compensation contacts 34. The compensation elements are each selected and configured to provide a predetermined amount of crosstalk compensation to the signal at the mating plug contacts 50. The crosstalk compensation is applied directly to the plug contacts 50 of the mating plug 12. The compensation contacts 34 are themselves non-current carrying contacts such that the crosstalk compensation is applied to the signal at the plug contacts 50 to effectively eliminate any electrical delay in the application of compensation to the plug contacts 50.

Figure 5:
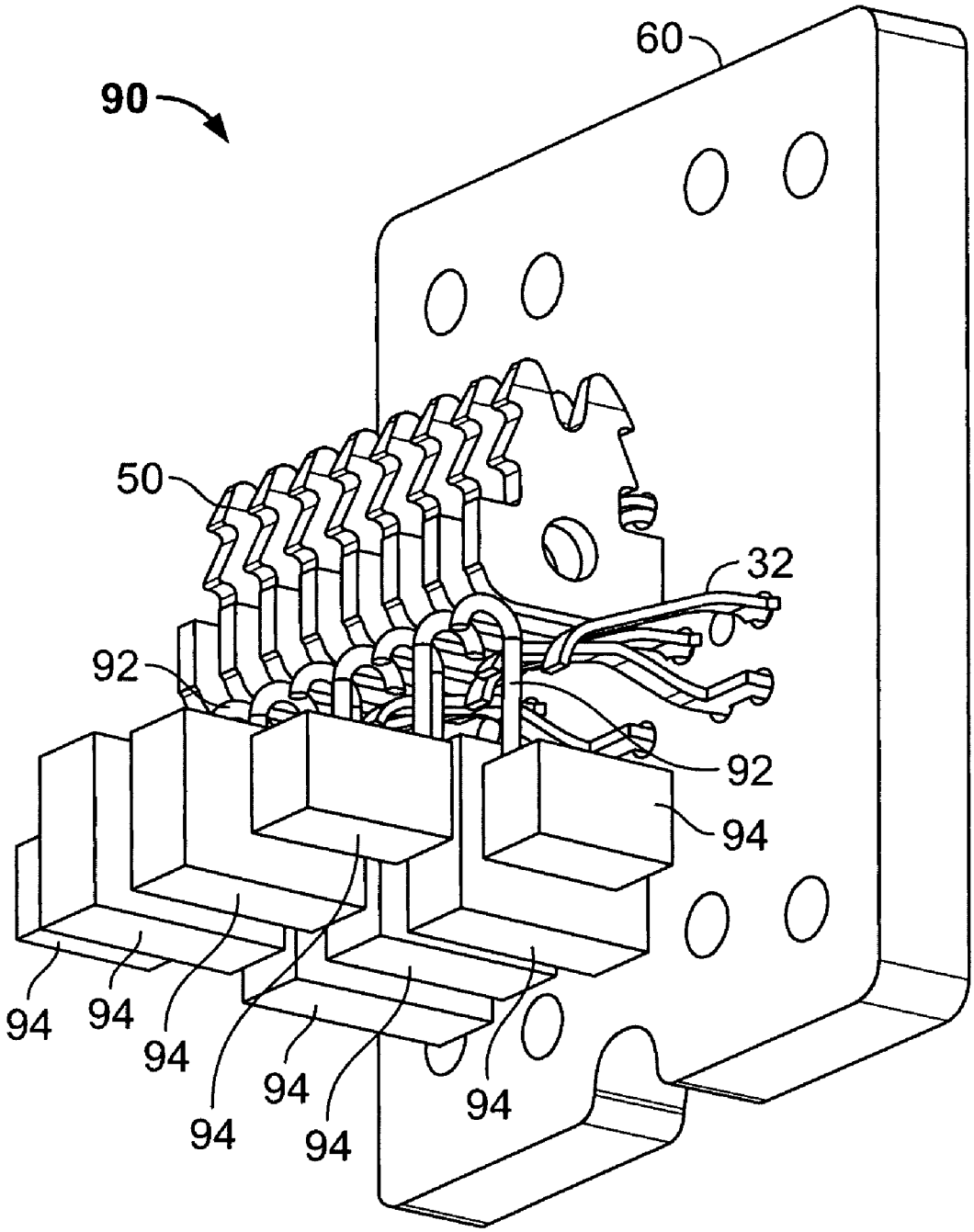
FIG. 5 is a perspective view of a jack insert with compensation contacts formed in accordance with an alternative embodiment of the present invention.

FIG. 5 is a perspective view of a jack insert 90 formed in accordance with an alternative embodiment of the present invention. The jack insert 90 includes the first circuit board 60, but is without a second circuit board. The jack insert 90 includes alternative compensation contacts 92. The compensation contacts 92 are mounted in the housing shell 24 (FIG. 1) proximate the mating face 26. The jack insert 90 also includes signal contacts 32. In FIG. 5, plug contacts 50 are shown as they would engage the signal contacts 32 and compensation contacts 92 when the plug 12 is mated with the jack 10. The compensation contacts 92 and signal contacts 32 are oriented so that both engage the plug contacts 50 independently of each other. In the illustrated embodiment, each of the compensation contacts 92 includes a plate 94 that is electrically connected to the compensation contact 92. In other embodiments, one or more of the compensation contacts 92 may not include a plate 94. The plates 94 are sized and configured in proximity to each other so that their electromagnetic fields will interact creating compensation elements. The compensation elements provide a predetermined amount of noise, or more specifically, crosstalk compensation.

In the embodiment shown in FIG. 5, the compensation contacts 92 are cane shaped and are oriented such that the compensation contacts 92 are alternately outwardly facing and inwardly facing to provide space for the plates 94. The alternating orientation of the compensation contacts 92 may also provide for flexibility in varying the electromagnetic coupling between the various plates 94. As previously described, the crosstalk compensation is applied directly to the plug contact 50. The compensation contacts 92 are non-current carrying contacts and therefore the crosstalk compensation is effectively applied to the plug contacts 50 without any electrical delay.

The embodiments thus described provide a modular jack 10 that compensates for crosstalk in the signals from a mating plug 12. The jack 10 applies the crosstalk compensation at the source of the crosstalk. The jack 10 includes a signal contact 32 and a separate compensation contact 34, 92 both of which engage the plug contact 50 of the mating plug 12. Crosstalk compensation is applied directly to the plug contact 50 of the plug 12. The compensation contact 34, 92 is a non-current carrying contact. In this manner compensation is effectively applied to the plug contact 50 without any electrical delay.

While the invention has been described in terms of various specific embodiments, those skilled in the art will recognize that the invention can be practiced with modification within the spirit and scope of the claims.

What is claimed is:

1. An electrical jack comprising:

a housing having a mating end configured to receive a mating plug;

a plurality of signal contacts arranged in differential pairs, each said signal contact carrying a signal from or to a plug contact in the mating plug; and a plurality of compensation contacts separate from, and associated with, the plurality of signal contacts, wherein each said compensation contact engages and each said associated signal contact separately directly engage a common respective plug contact in the mating plug independent of one another, and wherein said compensation contacts provide crosstalk compensation.

2. The electrical jack of claim 1, further comprising one or more compensation elements selected to provide a desired crosstalk compensation, and wherein at least two of said compensation contacts are connected to said one or more compensation elements.

3. The electrical jack of claim 1 further comprising a first circuit board, said signal contacts being mounted on said first circuit board.

4. An electrical jack comprising:

a housing having a mating end configured to receive a mating plug;

a plurality of signal contacts arranged in differential pairs, each said signal contact carrying a signal from or to a plug contact in the mating plug;

a plurality of compensation contacts, wherein each said compensation contact engages a respective plug contact in the mating plug independent of said signal contact, and wherein said compensation contacts provide crosstalk compensation; and a first circuit board holding said signal contacts and a second circuit board, said compensation contacts being connected to said second circuit board, and said second circuit board including compensation elements.

5. The electrical jack of claim 1 further comprising a circuit board, each said compensation contact including an attachment loop and bend portions cooperating with said attachment loop to attach said compensation contact to upper and lower surfaces at an outward end of said circuit board.

6. The electrical jack of claim 1, wherein each said compensation contact comprises a conductive element that is configured to electromagnetically couple with an adjacent conductive element to provide a desired reactance.

7. The electrical jack of claim 1, further comprising one or more compensation elements selected to provide a desired crosstalk compensation, and wherein said one or more compensation elements comprise two or more conductors in close proximity to each other on a circuit board.

8. The electrical jack of claim 1, further comprising one or more compensation elements selected to provide a desired crosstalk compensation, and wherein said one or more compensation elements comprise a discrete chip.

9. The electrical jack of claim 1, further comprising one or more compensation elements selected to provide a desired crosstalk compensation, and wherein said one or more compensation elements comprise a plurality of conductive plates in proximity with one another.

10. The electrical jack of claim 1, wherein said compensation contacts are non-signal carrying contacts.

11. The electrical jack of claim 1, wherein said jack is an RJ-45 jack.

12. The electrical jack of claim 1, further comprising at least one compensation element selected to provide a desired crosstalk compensation, and wherein the compensation is applied directly to the mating plug contact of the mating plug without electrical delay.

13. The electrical jack of claim 1, wherein said compensation contacts are held in said housing and each said compensation contact includes a compensation element directly attached thereto.

14. An electrical jack comprising:

a housing having a mating end configured to receive a mating plug;

a plurality of signal contacts, each said signal contact carrying a signal from or to a plug contact in the mating plug;

a plurality of compensation contacts disposed adjacent the mating end and separate from the plurality of signal contacts, selected ones of the compensation contacts being connected to respective compensation elements, wherein said compensation elements do not carry the signals from or to the plug contacts and are selected to provide a desired noise compensation, and wherein said noise compensation is applied to a noise source in the mating plug.

15. The electrical jack of claim 14 further comprising a first circuit board, said signal contacts being mounted on said first circuit board.

16. The electrical jack of claim 14 further comprising a first circuit board holding said signal contacts and a second circuit board, said compensation contacts being connected to said second circuit board, and said second circuit board including said compensation elements.

17. The electrical jack of claim 14, wherein each said compensation contact comprises a conductive element that is configured to electromagnetically couple with an adjacent conductive element to provide a desired reactance.

18. The electrical jack of claim 14, wherein said compensation contacts are non-signal carrying contacts.

19. The electrical jack of claim 14 further comprising a circuit board, each said compensation contact including an attachment loop and bend portions cooperating with said attachment loop to attach said compensation contact to upper and lower surfaces at an outward end of said circuit board.

20. The electrical jack of claim 14, wherein each off the compensation and signal contacts separately directly engage a common respective plug contact.

21. The electrical jack of claim 1, wherein the associated compensation contacts and signal contacts are not electrically connected to one another other than through the respective plug contacts.

22. The electrical jack of claim 14, wherein the associated compensation contacts and signal contacts are not electrically connected to one another other than through the respective plug contacts.

* * * * *